US011493002B1

(12) United States Patent
Chen et al.

(10) Patent No.: US 11,493,002 B1
(45) Date of Patent: Nov. 8, 2022

(54) UNDERMOUNT FOR EGR COOLER

(71) Applicant: Caterpillar Inc., Peoria, IL (US)

(72) Inventors: Allen Y. Chen, Dunlap, IL (US); Dean W. Walters, Rapid City, SD (US); Jason L. Van Farowe, Brimfield, IL (US); DeForest C. Gould, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/518,200

(22) Filed: Nov. 3, 2021

(51) Int. Cl.

| | |
|---|---|
| ***F02M 26/12*** | (2016.01) |
| ***F02M 26/24*** | (2016.01) |
| ***F02M 26/30*** | (2016.01) |
| ***F02M 37/00*** | (2006.01) |
| ***F02M 55/00*** | (2006.01) |
| ***F02M 63/02*** | (2006.01) |
| ***F02M 26/32*** | (2016.01) |

(52) U.S. Cl.
CPC ..... *F02M 26/12* (2016.02); *F02M 26/24* (2016.02); *F02M 26/30* (2016.02); *F02M 26/32* (2016.02); *F02M 37/0017* (2013.01); *F02M 55/002* (2013.01); *F02M 63/0275* (2013.01); *F02M 2200/85* (2013.01)

(58) Field of Classification Search
CPC ..... F02M 26/24; F02M 26/30; F02M 26/32; F02M 26/12
See application file for complete search history.

(56) References Cited

U.S. PATENT DOCUMENTS

| | | | | |
|---|---|---|---|---|
| 4,258,687 | A | 3/1981 | Mauch et al. | |
| 6,244,255 | B1 * | 6/2001 | Sagata | F02M 35/10327 123/568.17 |
| 7,516,737 | B2 * | 4/2009 | Cerabone | F02M 26/32 123/41.29 |
| 9,303,595 | B2 * | 4/2016 | Forshier | F02M 26/30 |
| 10,400,714 | B2 * | 9/2019 | Rixon | F28F 9/0278 |
| 11,149,624 | B1 * | 10/2021 | Walters | F02M 26/30 |
| 2011/0315129 | A1 * | 12/2011 | Kojima | F02M 26/25 123/568.12 |
| 2015/0059715 | A1 * | 3/2015 | Forshier | B22D 19/0072 123/568.12 |

FOREIGN PATENT DOCUMENTS

| | | |
|---|---|---|
| CN | 203742840 U | 7/2014 |

* cited by examiner

*Primary Examiner* — Xiao En Mo
(74) *Attorney, Agent, or Firm* — Bookoff McAndrews, PLLC

(57) ABSTRACT

An exhaust gas recirculation (EGR) cooler for mounting to a coolant collector bracket may include a cooler body having a top, a bottom, a length extending in a longitudinal direction, and a width extending in a lateral direction perpendicular to the longitudinal direction, and at least one mount coupled to the bottom of the cooler body. An interior of the mount may be in fluid communication with an interior of the cooler body. A width of the at least one mount in the lateral direction of the cooler body may be equal to or less than the width of the cooler body. The at least one mount may be positioned such that the mount does not extend beyond the width of the cooler body.

20 Claims, 9 Drawing Sheets

UNDERMOUNT FOR EGR COOLER

TECHNICAL FIELD

The present disclosure relates generally to an engine system, and more particularly, to an engine system having an undermount associated with an exhaust gas recirculation (EGR) cooler.

BACKGROUND

An exhaust gas recirculation (EGR) system supplies engine exhaust back to the intake side of the engine. The recirculated exhaust gases may be cooled along the path to the intake side of the engine by an EGR cooler that receives engine coolant.

CN 203742840 discloses an EGR cooler and an EGR cooler support. The EGR cooler support includes a base and vertical plates connected with clamp straps. The clamp straps are used to fasten the EGR cooler onto the EGR cooler support. The upper ends of the clamp straps are hinged to the tops of the vertical plates. The lower ends of the clamp straps are provided with penetration slotted holes. Fasteners are arranged in the penetration slotted holes and coupled to fixing holes provided in the base.

The EGR system of the present disclosure may solve one or more problems in the art. The scope of the current disclosure, however, is defined by the attached claims, and not by the ability to solve any specific problem.

SUMMARY

In one aspect, an exhaust gas recirculation (EGR) cooler for mounting to a coolant collector bracket may include a cooler body having a top, a bottom, a length extending in a longitudinal direction, and a width extending in a lateral direction perpendicular to the longitudinal direction, and at least one mount coupled to the bottom of the cooler body. An interior of the mount may be in fluid communication with an interior of the cooler body. A width of the at least one mount in the lateral direction of the cooler body may be equal to or less than the width of the cooler body. The at least one mount may be positioned such that the mount does not extend beyond the width of the cooler body. The at least one mount may be welded or brazed to the cooler body.

Each mount of the at least one mount may include a top opening at least partially aligning with an inlet or an outlet of the cooler body. Each mount of the at least one mount may include a bottom opening. Centers of the top opening and the bottom opening may be offset with respect to the longitudinal direction of the cooler body.

The cooler body may include a coolant inlet and a coolant outlet. The at least one mount may include a first mount and a second mount. The first mount may include a first top opening in fluid communication with the coolant inlet. The second mount may include a second top opening in fluid communication with the coolant outlet.

Each mount of the at least one mount may include a mount top surface coupled to the cooler and having a mount top opening, a mount bottom surface opposite the mount top surface and having a mount bottom opening, a side surface vertically extending between the mount top and bottom surfaces, and at least one fastener hole configured to receive a fastener.

The at least one fastener hole may include a pair of fastener holes formed in the mount bottom surface. The mount bottom opening may be provided between the pair of fastener holes. The mount bottom surface may include a ring portion defining the mount bottom opening, and a pair of wings extending from the ring portion. Each wing may have one fastener hole of the pair of fastener holes. The side surface may include a pair of extension portions extending above the pair of fastener holes, respectively.

The cooler may be cylindrical. The cooler may include a plurality of tubes inserted through the cooler body and extending in the longitudinal direction. The plurality of tubes may be configured to receive exhaust. The at least one mount may include a top surface having a curvature configured to surround a portion of the bottom of the cooler body.

In another aspect, an exhaust gas recirculation (EGR) cooler for mounting to a coolant collector bracket may include a cooler body having a top, a bottom, and a length extending in a longitudinal direction, and at least one mount coupled to a bottom of the cooler body. Each mount of the at least one mount may include a mount top opening at least partially aligning with an inlet or an outlet of the cooler body, and a mount bottom opening. Centers of the mount top opening and the mount bottom opening may be offset with respect to the longitudinal direction of the cooler body.

The cooler body may have a width extending in a lateral direction perpendicular to the longitudinal direction. A width of the at least one mount extending in the lateral direction of the cooler body may be less than or equal to the width of the cooler body.

The at least one mount may include a first mount and a second mount spaced apart in the longitudinal direction of the cooler body. A distance between the mount bottom openings of the first and second mounts may be less than a distance between the mount top openings of the first and second mounts. The first mount and the second mount ay have a same structure. The first mount and the second mount may be symmetrical with respect to a lateral axis extending in a lateral direction at a position between the first and second mounts.

In another aspect, an exhaust gas recirculation (EGR) cooler system may include an exhaust gas recirculation (EGR) cooler having a length extending in a first direction and a width extending in a second direction, a coolant collector bracket configured to vertically support the cooler and configured to be coupled to a cylinder head of an internal combustion engine, and at least one mount coupling the cooler to the coolant collector bracket. Each mount of the at least one mount may have a passage to allow fluid communication between an interior of the cooler and an interior of the coolant collector bracket. Widths of the at least one mount and the coolant collector bracket extending in the second direction may be less than or equal to the width of the cooler.

The cooler may include a coolant inlet and a coolant outlet, the coolant collector bracket may include a top surface having an EGR coolant inlet and an EGR coolant outlet, and the passage of the at least one mount may be configured to connect the coolant inlet to the EGR coolant outlet or to connect the coolant outlet to the EGR coolant inlet.

The coolant inlet may be spaced apart from the EGR coolant outlet with respect to the first direction, and the coolant outlet of the cooler may be spaced apart from the EGR coolant inlet with respect to the first direction. A longitudinal center axis of an extension portion of the coolant collector bracket may extend in the first direction and may be offset with respect to a center of the cooler in the second direction.

The mount may be brazed or welded to the cooler. The mount may be bolted to the coolant collector bracket via at least one bolt. The at least one bolt may be positioned directly under the cooler so as not to extend beyond the width of the cooler.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
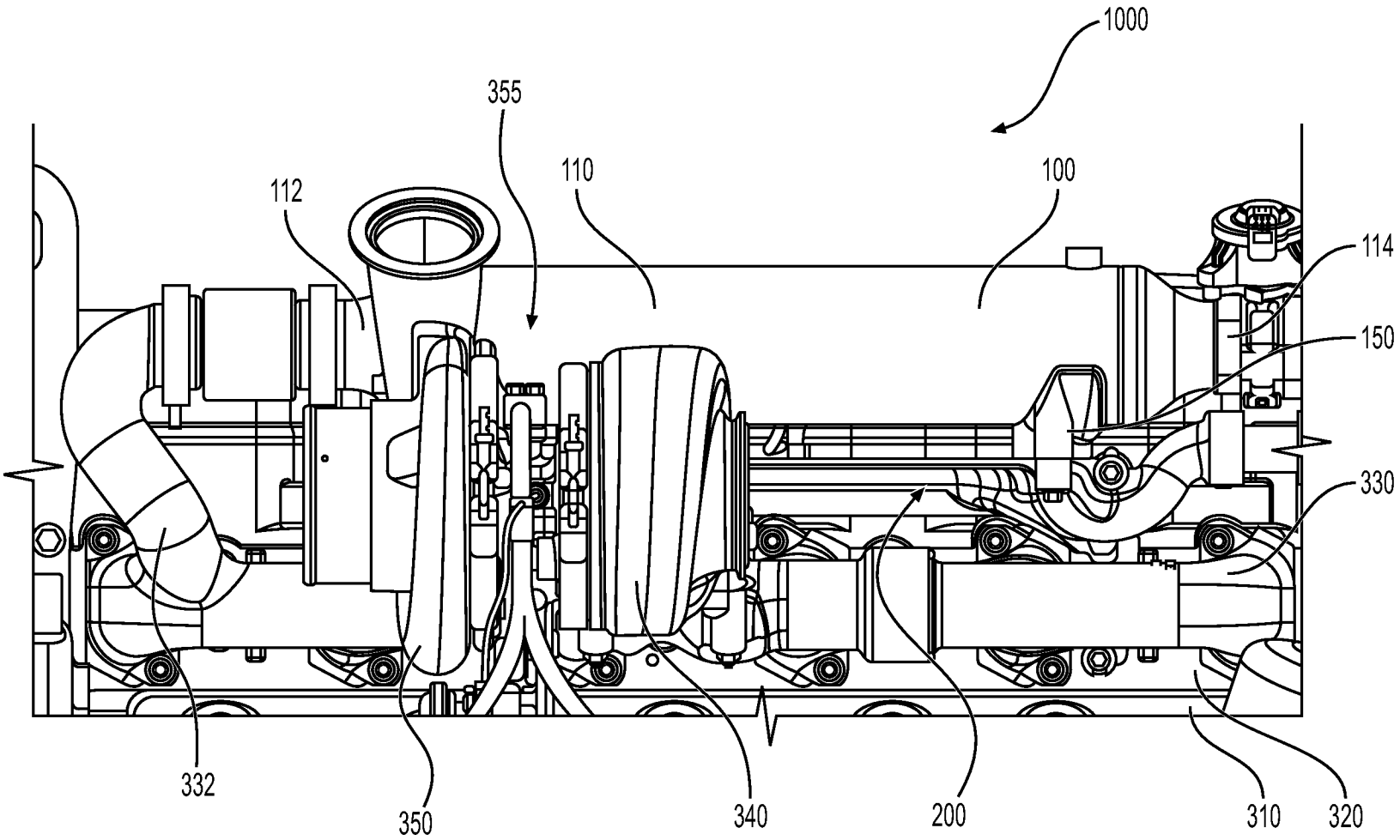
FIG. 1 is a side view of an exemplary embodiment of an engine system including an exhaust gas recirculation (EGR) cooler, according to aspects of the disclosure.

FIG. 1 illustrates a front view of an exemplary embodiment of an engine system 1000 including an exhaust gas recirculation (EGR) cooler 100, a coolant collector bracket 200, a cylinder block 310, a cylinder head 320 attached to the cylinder block 310, an exhaust manifold 330, and a turbocharger system 355 having at least one compressor 350 and at least one turbine 340.

The cooler 100 may include a cooler body 110 and a pair of mounts 150, 152 (see FIG. 3) to couple the cooler body 110 to the coolant collector bracket 200. The cooler 100 may form a portion of an EGR flowpath described in more detail with reference to FIG. 2.

Figure 8:
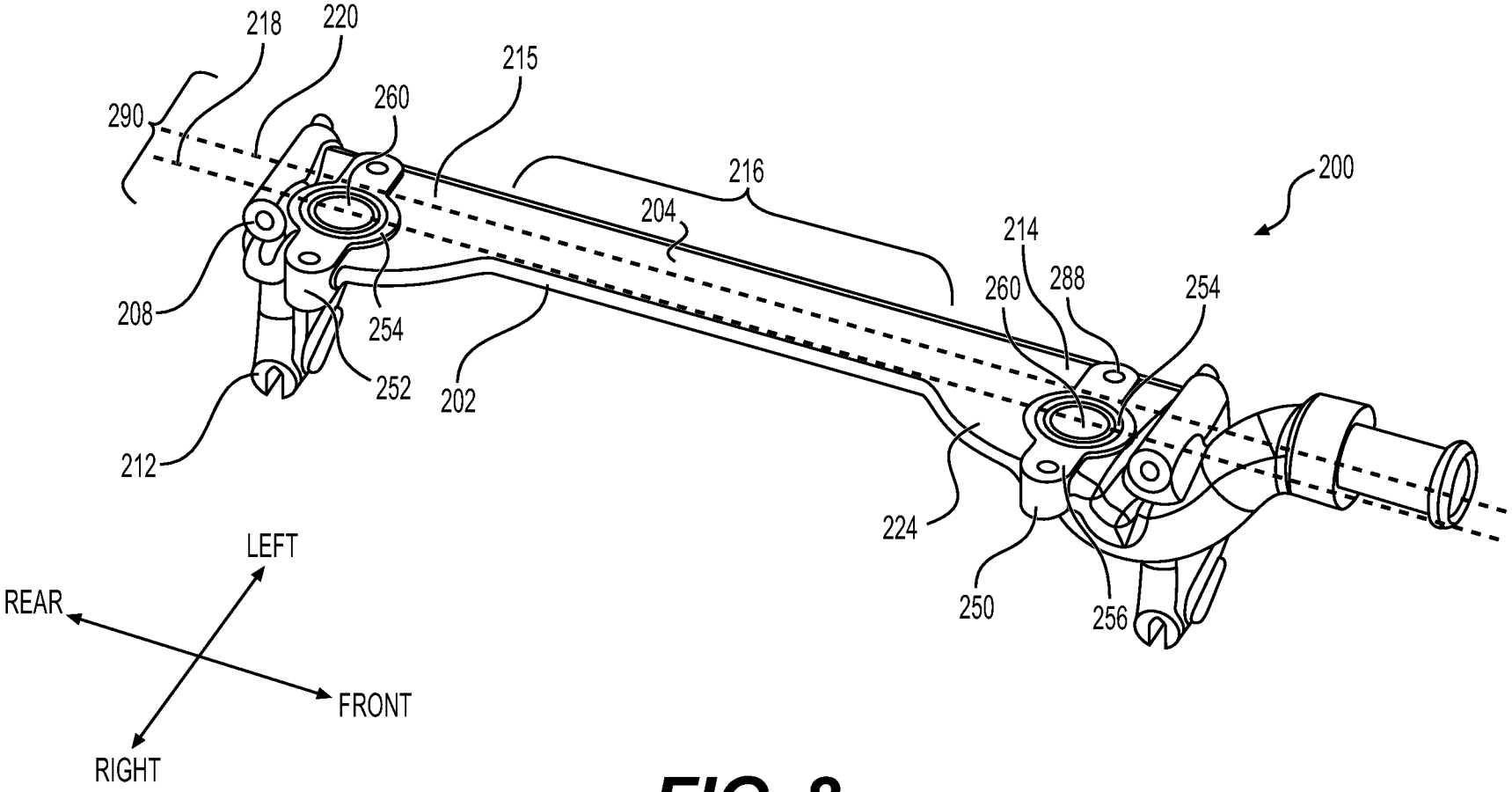
FIG. 8 is a perspective view of the coolant collector bracket of FIG. 1.

The cooler body 110 may extend longitudinally in a first direction (e.g., a front-rear direction per the coordinate system shown in FIG. 8). The cooler body 110 may be a heat-exchanger having an EGR inlet 112 at one end and an EGR outlet 114 at an opposite end. The EGR inlet 112 may be coupled to the exhaust manifold via EGR bypass line 332 to receive exhaust.

The coolant collector bracket 200 may be coupled or attached to a side of the cylinder head 320. For example, the coolant collector bracket 200 may be mounted to a generally vertical surface of the cylinder head 320. The coolant collector bracket 200 may have a generally parallel and vertical mounting interface with cylinder head 320, and a generally parallel and horizontal mounting interface with the cooler 100.

The coolant collector bracket 200 may extend longitudinally in the first direction under the cooler body 110. The coolant collector bracket 200 may vertically support the cooler 100 at the mounts 150, 152. An interior of the coolant collector bracket 200 may be in fluid communication with an interior of the cooler 100 via the mounts 150, 152, as will be described in more detail below.

The cylinder block 310 and cylinder head 320 may include a plurality of internal coolant passages or sumps (not shown) as part of a coolant circuit to cool the engine system 1000. The coolant circuit may take any appropriate form, and may include, for example, a coolant sump, one or more coolant pumps, and a radiator or similar device (not shown). Coolant may flow from the cylinder head 320 through the coolant collector bracket 200 and cooler 100 to cool exhaust flowing through the cooler body 110.

The exhaust manifold 330 may be coupled to the cylinder head 320. The turbine 340 may be connected to the exhaust manifold 330, and the compressor 350 may be connected to the intake manifold of the engine. The turbine 340 and compressor 350 may be provided at a side of the coolant collector bracket 200 opposite a side having the cylinder head 320 (e.g., right side with respect to the coordinate system in FIG. 8).

Figure 2:
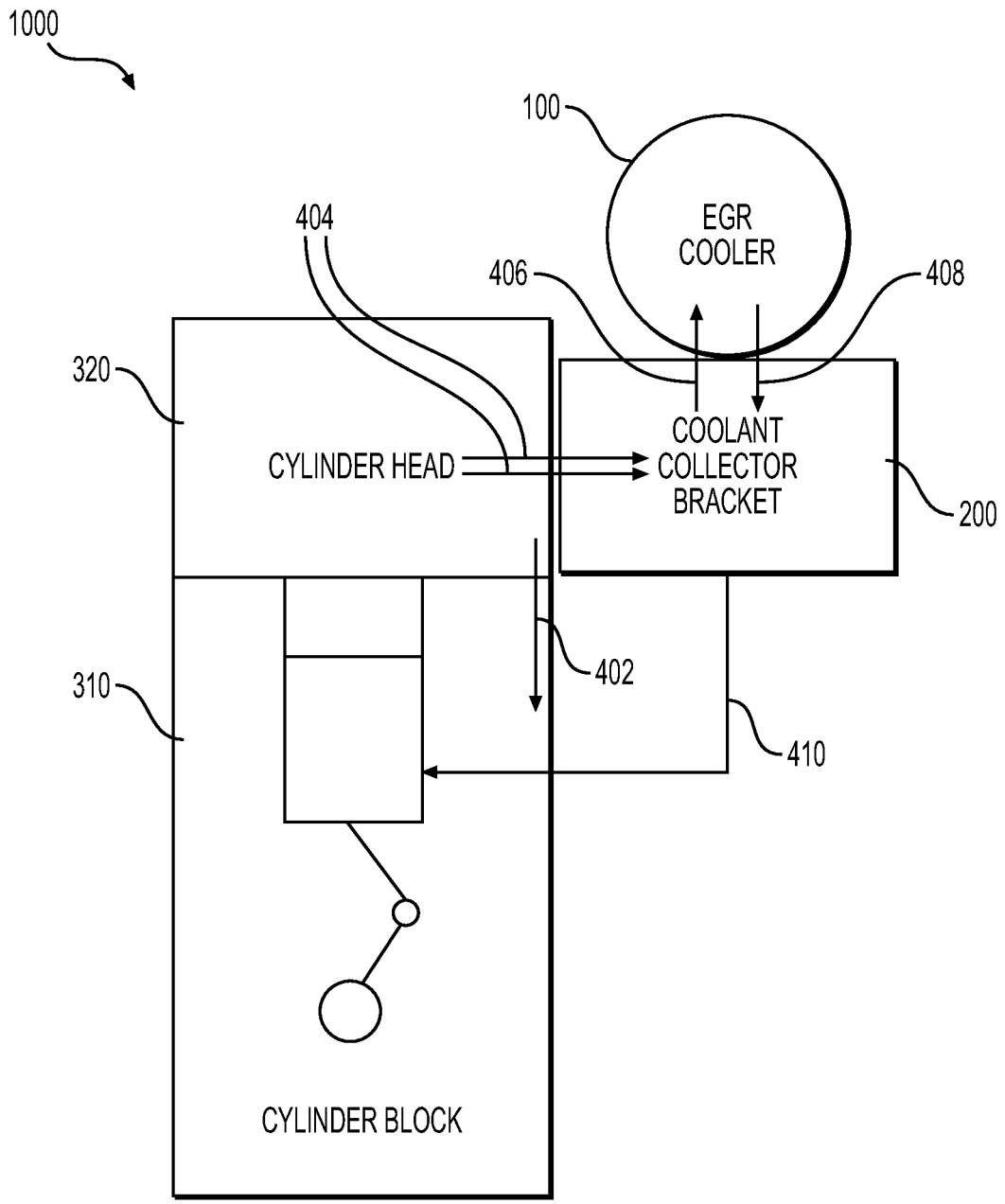
FIG. 2 is a schematic representation of the engine system and EGR cooler of FIG. 1.

FIG. 2 schematically depicts an end view of the engine system 1000. The coolant collector bracket 200 may be secured to a side of the cylinder head 320, and the EGR cooler 100 may be secured to a top of the coolant collector bracket 200. Coolant may flow from the cylinder head 320 to the cylinder block 310 in a top-down flow, as indicated by arrow 402. Coolant may flow from the cylinder head 320 to the coolant collector bracket 200, as indicated by arrows 404. Coolant may flow from the coolant collector bracket 200 to the EGR cooler 100, as indicated by arrow 406, and coolant may flow from the EGR cooler 100 back into the coolant collector bracket 200, as indicated by arrow 408. Coolant may flow from coolant collector bracket 200 back to cylinder block 310, as indicated by arrow 410. In the exemplary embodiment, the coolant in coolant collector bracket 200 may flow to a casted-in collector rail (not shown) in cylinder block 310. This collector rail may be a cylinder block configured to receive coolant from coolant collector bracket 200.

Figure 3:
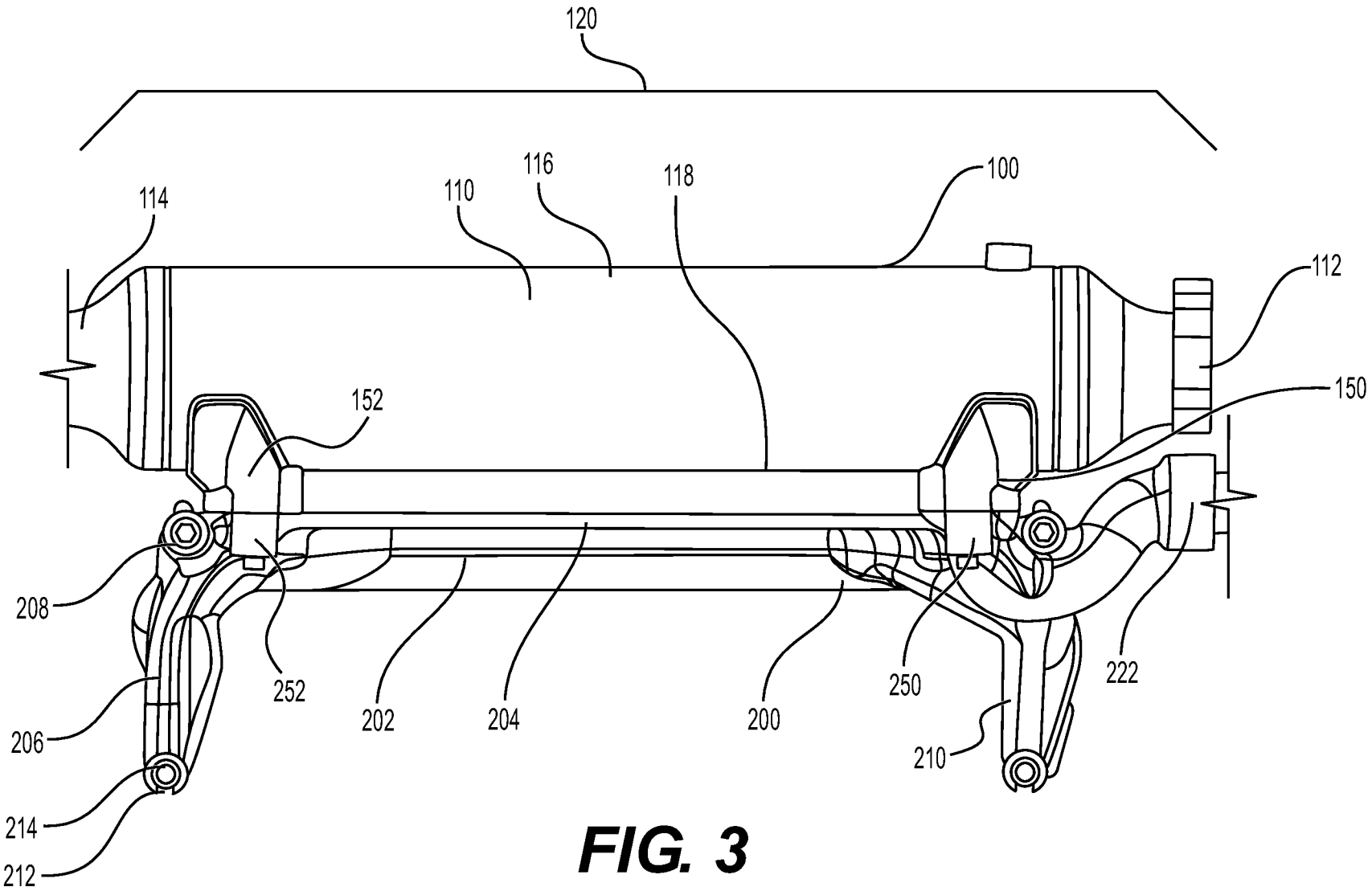
FIG. 3 is a side view of the EGR cooler and coolant collector bracket of FIG. 1.

FIG. 3 is a side view of the EGR cooler 100 and coolant collector bracket 200 of FIG. 1 with the exhaust manifold 330 and turbocharger system 355 removed. The cooler body 110 may be an elongated container with, for example, a cylindrical shape. Aspects disclosed herein are not limited to a shape of the cooler body 110. The cooler body 110 may be made of a rigid material with a high melting temperature (e.g., metal). The cooler body 110 may have a top 116, a bottom 118, a length 120 extending in a longitudinal (or front-rear) direction, and a width 140 (FIG. 6) extending in the transverse or lateral direction.

The mounts 150, 152 may also be made of a rigid material with a high melting temperature (e.g., metal). The mounts 150, 152 may be coupled or fixed (e.g., welded, brazed, or fused) to the bottom 118 of the cooler body 110 and extend downward to couple the cooler body 110 to the coolant collector bracket 200. While the EGR cooler 100 is shown with a front and rear mount 150, 152, more or less mounts may be included. The mounts 150, 152 may alternatively be referred to as undermounts or first and second mounts.

The coolant collector bracket 200 may include a bracket body 202 and a plurality of mounting legs 206, 210 extending downward from the bracket body 202 to couple to the cylinder head 320. The bracket body 202 may be located vertically under the cooler body 110 and follow the longitudinal direction of the cooler body 110.

The bracket body 202 may have a top surface 204, mounting interfaces or fasteners 250, 252, and a jumper tube 222. The mounting interfaces 250, 252 may form a part of the top surface 204. The mounting interfaces 250, 252 may be coupled (e.g., bolted or screwed) to the mounts 150, 152 of the EGR cooler 100, as will be described in more detail below.

The jumper tube 222 may be provided at an end (e.g., front end) of the bracket body 202. The jumper tube 222 may be secured to the cylinder block 310, allowing fluid communication between the coolant collector bracket 200 and the cylinder block 310.

The plurality of mounting legs 206, 210 may include front and rear legs, but aspects disclosed herein are not limited to a number of mounting legs 206, 210. When the exhaust manifold 330 (FIG. 1) is coupled to the cylinder head 320, the mounting legs 206 of the coolant collector bracket 200 may be located between the exhaust manifold 330 and the cylinder head 320.

The plurality of mounting legs 206, 210 may be similarly configured and include a plurality of fastener connectors 208, 214 to couple to the cylinder head 320. The plurality of fastener connectors 208, 214 may be sized and configured to receive appropriate cylinder head fasteners (e.g., cylinder head bolts). The plurality of fastener connectors 208, 214 may form a top fastener connector 208 and a bottom fastener connector 214.

The top fastener connector 208 may be located adjacent a junction or transition between the bracket body 202 and the mounting leg 206. The top fastener connector 208 may include a generally round, threaded or non-threaded opening extending transversely through the mounting leg 206 in a direction perpendicular to the longitudinal direction of the bracket body 202. Alternatively, the top fastener connector 208 may have shaped other than round shapes.

The bottom fastener connector 214 may be located at a distal-most end of the mounting leg 206. The bottom fastener connector 214 may form a round opening and include a bottom gap or slot 212 at a bottom surface of mounting leg 206 such that the bottom fastener connector 214 may have a generally C-shape. The bottom gap 212 may facilitate a sliding connection or snap-fitting onto a fastener of the cylinder head 320. Aspects disclosed herein, however, are not limited to a mounting arrangement of the mounting legs 206, 210 and the cylinder head 320. As noted above, mounting leg 210 may include the same features described above with respect to mounting leg 206.

Figure 4A:
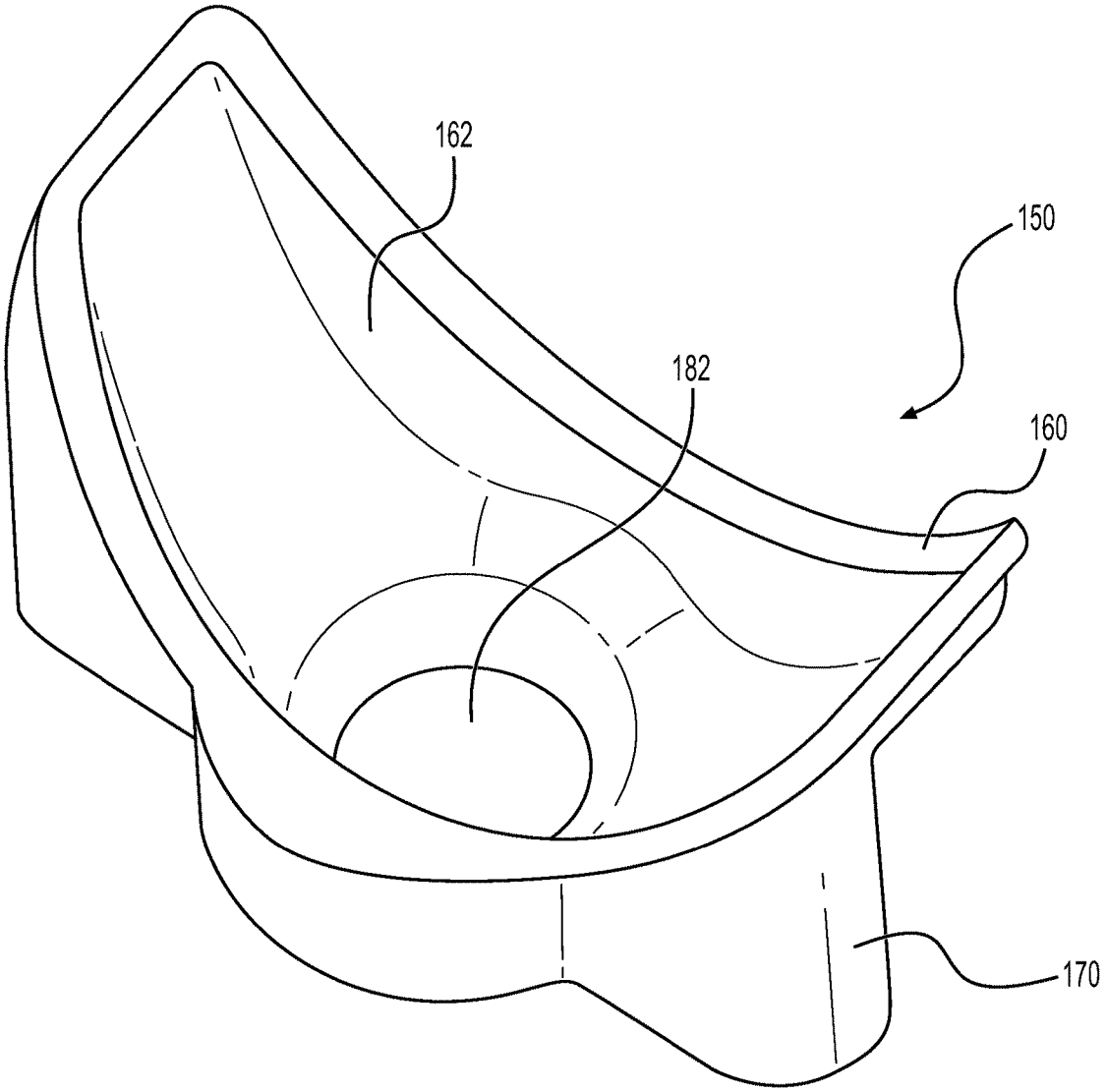
FIG. 4A is a top perspective view of a mount of the EGR cooler of FIG. 1.
Figure 4B:
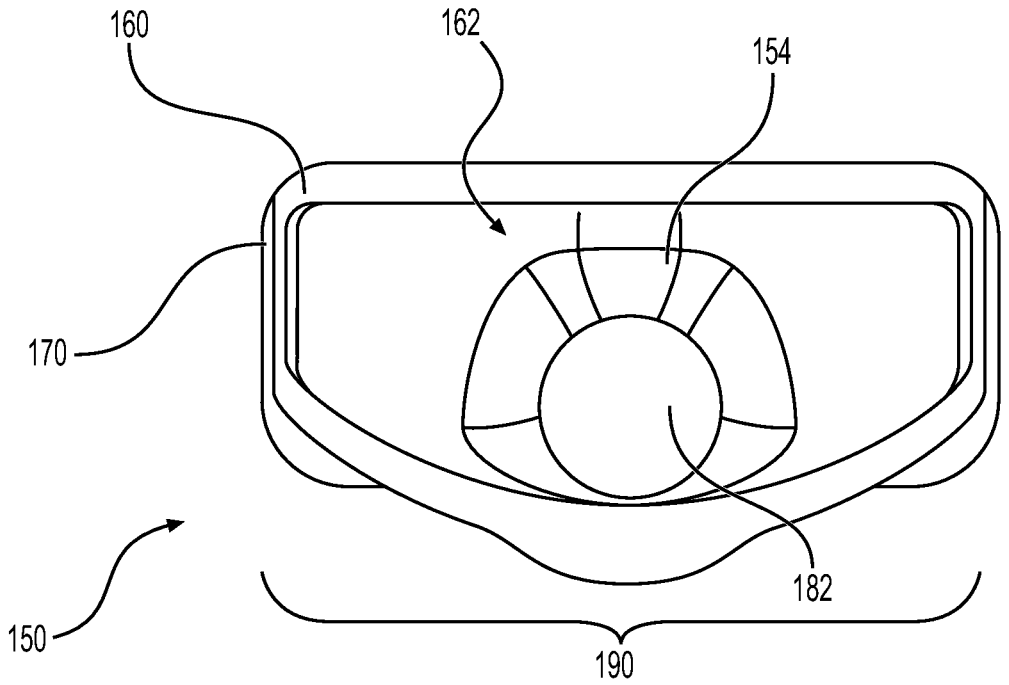
FIG. 4B is a top view of the mount of FIG. 4A.

FIGS. 4A and 4B illustrate a top view of the mount 150 with the EGR cooler body 110 removed. Mount 152 may be similarly arranged. The mount 150 may include a top surface 160, a bottom surface 180, a side surface 170, a passage 154, and a width 190. The top surface 160 may alternatively be referred to as a mount top surface. The top surface may include a top opening 162, which may alternatively be referred to as a mount top opening. The top surface 160 may define a rim or edge that has a shape similar to a rectangular or curved arc shape. For example, one edge of the top surface 160 may be straight, while an opposite edge of the top surface 160 may be curved (as shown in the top view of FIG. 4B), but aspects disclosed herein are not limited to a shape of the top surface 160. The top surface 160 may have a curvature configured to surround a portion of the bottom 118 of the cooler body 110, as seen in a side view, or the perspective view of FIG. 4A. When the top surface 160 is coupled (e.g., welded) to the cooler body 110, the top opening 162 may be defined within a coupled or welded portion of the top surface 160.

The bottom surface 180 may alternatively be referred to as a mount bottom surface. The bottom surface 180 may include a bottom opening 182, which may alternatively be referred to as a mount bottom opening. The bottom surface 180 will be described in more detail with reference to FIG. 5. The side surface 170 of mount 150 may vertically extend between the top surface 160 and the bottom surface 180. The side surface 170 will be described in more detail with reference to FIG. 6. The passage 154 may extend between the top opening 162 and the bottom opening 182 to allow fluid communication between the top opening 162 and the bottom opening 182.

Figure 6:
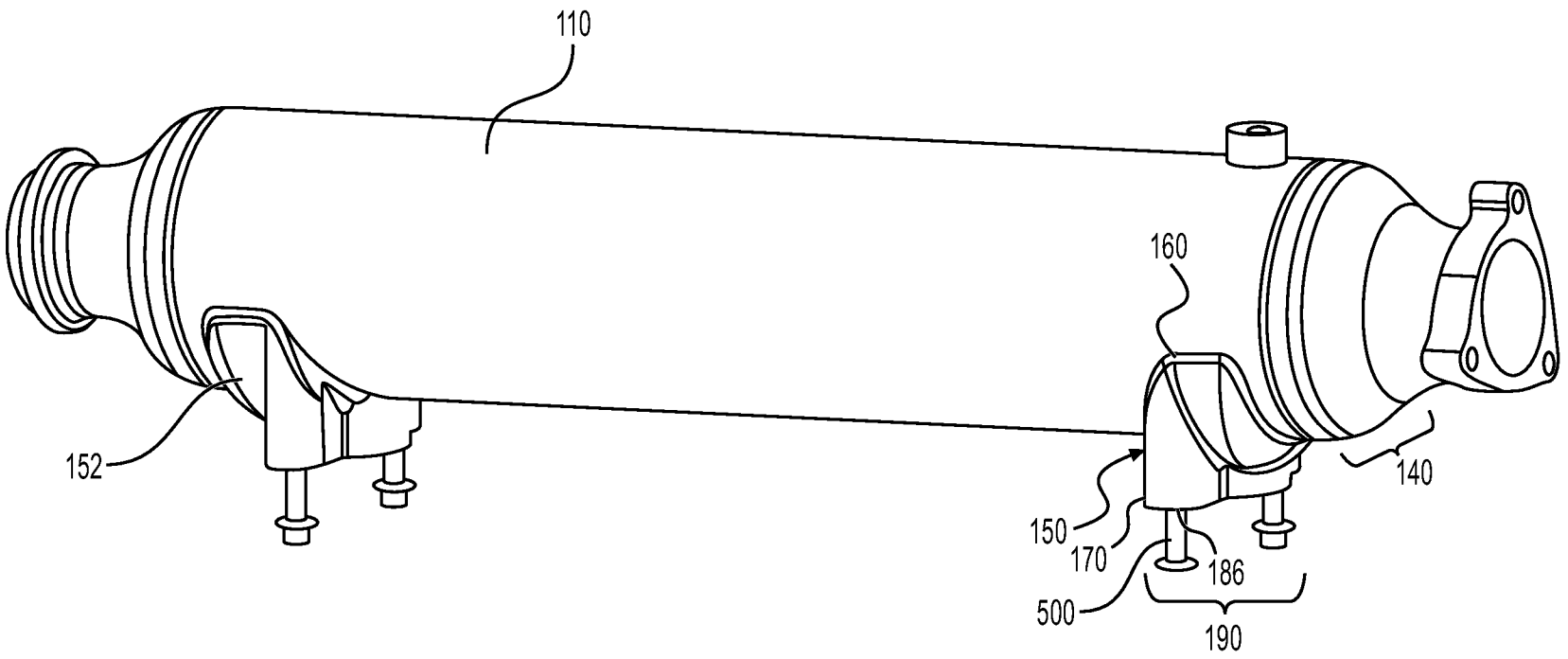
FIG. 6 is a perspective view of the EGR cooler of FIG. 1 with mounts and bolts.
Figure 7:
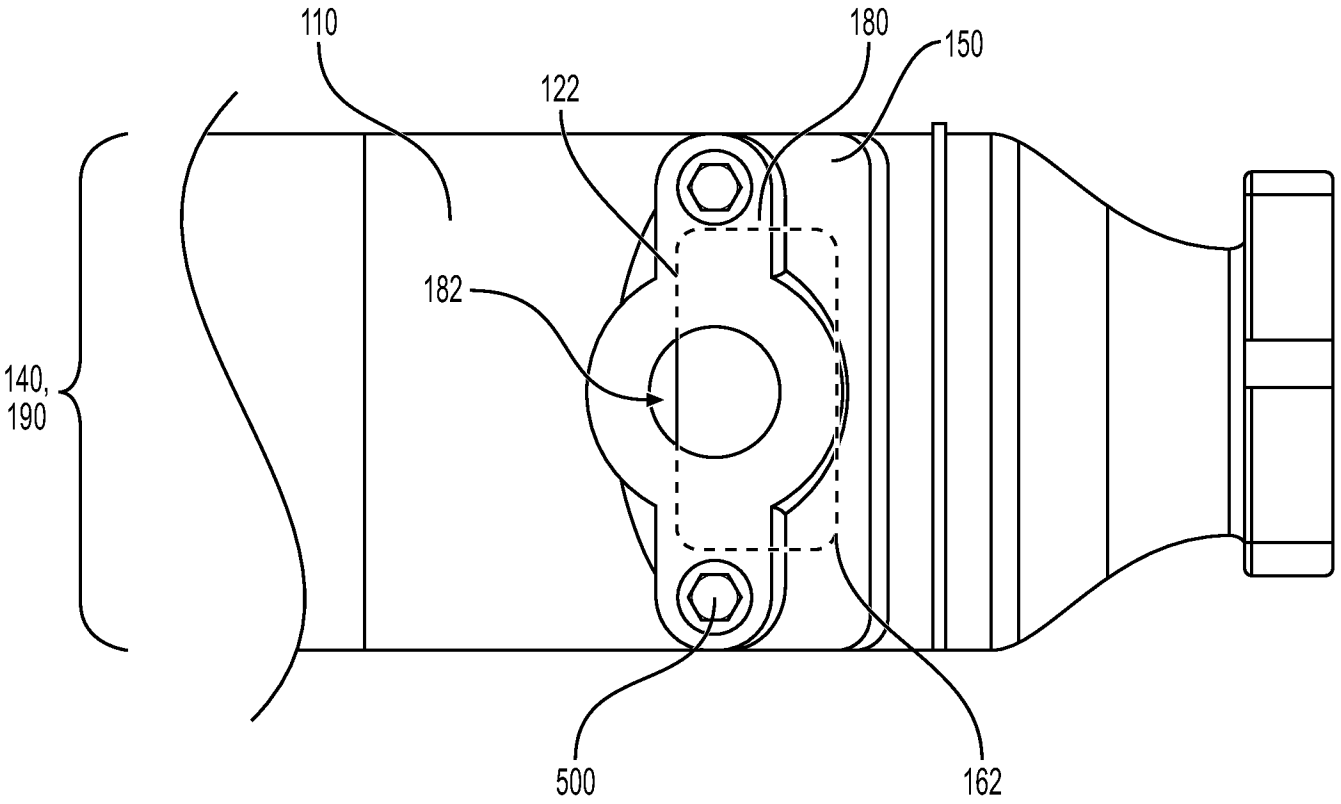
FIG. 7 is a bottom view of a mount and EGR cooler of FIG. 1 with bolts.
Figure 9:
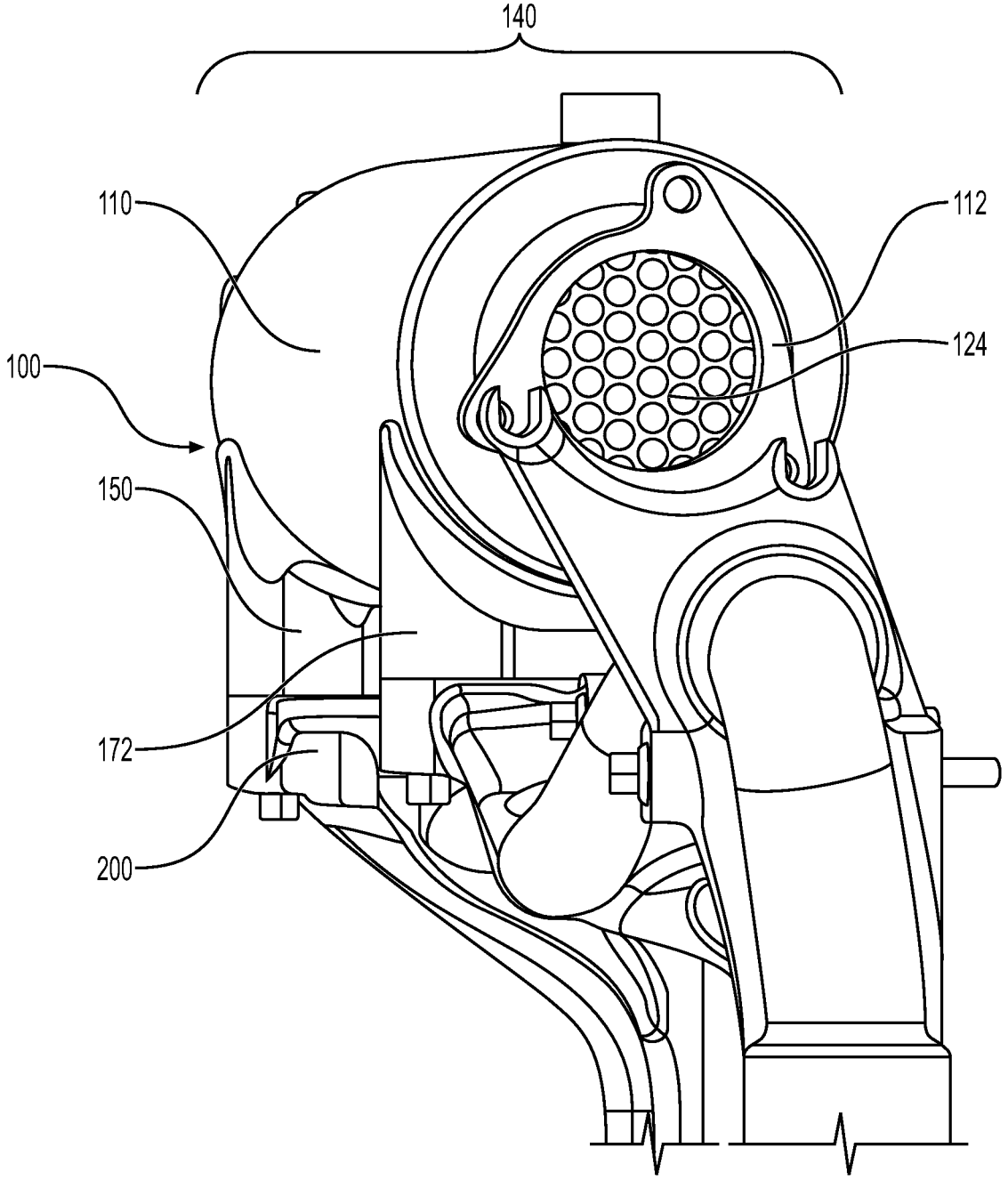
FIG. 9 is a perspective front view of the cooler and coolant collector bracket of FIG. 1.

The width 190 of the mount 150 may extend in a transverse or lateral direction which is perpendicular to the longitudinal direction of the cooler body 110. The width 190 may be defined by opposite sides (e.g., left and right sides) of the side surface 170, the bottom surface 180, and/or the top surface 160. As is shown in FIGS. 6, 7, and 9, the width 190 of the mount 150 may be less than or equal to the width 140 of the cooler body 110 (FIG. 3).

Figure 5:
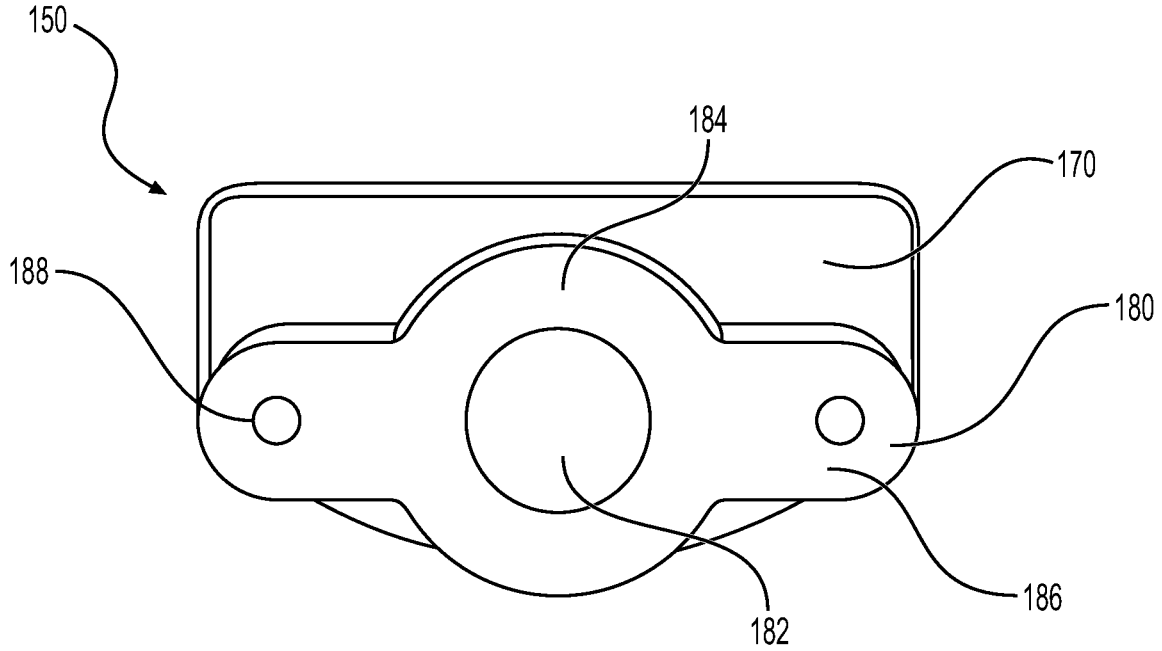
FIG. 5 is a bottom view of the mount of FIGS. 4A and 4B.

FIG. 5 illustrates a bottom view of the mount 150. The bottom surface 180 may be flat to facilitate coupling to the top surface of the coolant collector bracket 200 (FIG. 3), which may also be flat, but embodiments disclosed herein are not limited. A shape of the bottom surface 180 may be configured based on a shape of the mounting interface 250 of the coolant collector bracket 200 (FIG. 3). The bottom surface 180 may include a ring portion or surface 184 and a connection portion or contact surface 186. The ring portion 184 may define the bottom opening 182.

The connection portion 186 may be configured to be coupled (e.g., bolted) to the mounting interface 250 of the coolant collector bracket. The connection portion 186 may be implemented as two wings or extensions laterally extending from the ring portion 184. The wings of the connection portion 186 may lie along a same line and extend in a same (e.g., left-right) direction. The ring portion 184 and the bottom opening 182 may be provided between the pair of wings of the connection portion 186. The connection portion 186 may define the width 190 of the mount 150 (FIG. 4B).

The connection portion 186 may include a plurality of fastener holes 188 (e.g., stud or bolt holes). For example, when the connection portion 186 is implemented as a pair of wings, each wing of the connection portion 186 may include one fastener hole 188. The ring portion 184 and the bottom opening 182 may be provided between the pair of fastener holes 188.

Referring to FIGS. 5 and 6, each fastener hole 188 may be configured to receive one fastener 500 (e.g., posts, studs, bolts, screws, pins, rods, etc.) among a plurality of fasteners 500. While mount 150 may be used with any appropriate fastener, such as studs, bolts, posts, etc., the use of bolts 500 and bolt holes 188 will be referenced hereinafter for ease of reference. The bolt 500 may be a threaded type. A top end of the bolt 500 may be inserted into the bolt hole 188. A bottom end of the bolt 500 may be inserted into the mounting interface 250 of the coolant collector bracket 200 (FIG. 3).

The side surface 170 may include extension or post portions that extend vertically between the connection portion 186 and the top surface 160. An interior space or recess for top ends of the bolts 500 may be formed within the extension portions of the side surface 170, which may extend above the bolt holes 188.

As shown in FIG. 6, the cooler 100 may include two mounts 150, 152 to support the cooler body 110. The two mounts 150, 152 may be spaced apart in the longitudinal direction of the cooler body 110. As noted above, the two mounts 150, 152 may have a same or similar structure and may have a symmetrical arrangement with respect to a left-right axis (according to the coordinate system of FIG. 8) extending between the two mounts 150, 152 such that the mounts 150, 152 are mirror images of each other. One of the two mounts, e.g., mount 150 may be coupled to a first or front end of the cooler body 110, and the other of the two mounts, e.g., 152 may be coupled to a second or rear end of the cooler body 110. However, aspects disclosed herein are not limited to a number and position of the mounts 150. A position of the mount 150, 152 may be configured to allow fluid communication between the passage 154 of the mount 150, 152 (FIG. 5) and an interior of the cooler body 110.

FIG. 7 illustrates a bottom view of the front end of cooler body 110, including showing a coolant opening 122 formed in cooler body 110. This coolant opening 122 forms a coolant outlet from EGR cooler body 110. As shown, the mount 150 may be positioned under the coolant opening 122. The position of the mount 150 may be configured such that the top opening 162 (FIGS. 4A and 4B) covers coolant opening 122 so as to be in fluid communication with the coolant opening 122. In addition, the position of the mount 150 may be configured such that the mount 150 does not extend beyond the width 140 of the cooler body 110.

A center of the bottom opening 182 may be offset in a longitudinal direction of the cooler body 110 from a center of the top opening 162 of the mount 150. The center of the bottom opening 182 may also be longitudinally offset with respect to a center of the coolant opening 122. The bottom opening 182 may at least partially align or overlap with the coolant opening 122, but alternatively, the mount 150 may be configured such that the bottom opening 182 may be completely behind the top opening 162 and/or coolant opening 122 of the cooler body 110. As another alternative, centers of the top opening 162 and the bottom opening 182 may be aligned, which may be offset or aligned with the center of the coolant opening 122 of the cooler body 110. As will be described in more detail with reference to FIG. 8, a configuration of the passage 154 (FIG. 4B) and/or positions of the top opening 162 and bottom opening 182 of mount 150 may be adjusted based on a position of the coolant opening 122 of the cooler body 110 with respect to a position of an EGR coolant opening 260 (FIG. 8) of the coolant collector bracket 200.

Although FIG. 7 illustrates the coolant opening 122 at the front end of the cooler body 110, the cooler body 110 may include another coolant opening 122 at the rear end of the cooler body 110 associated with mount 152. As shown in FIGS. 6-7, the two mounts 150, 152 may mirror or be opposite to each other. A distance between the top openings 162 of the two mounts 150, 152 may be less than a distance between the bottom openings 182 of the two mounts 150, 152.

Referring to FIGS. 5 and 8, a shape of the top surface of the mounting interfaces 250, 252 of coolant collector bracket 200 may correspond to a shape of the bottom surface 180 of the mounts 150, 152. The mounting interfaces 250, 252 may include a ring portion 254 and a connection portion 256. The ring portion 254 may define the EGR coolant opening 260. The ring portion 254 may be configured to align with the ring portion 184 of the mounts 150, 152.

The connection portions 256 (e.g., two wings) of mounts 150, 152 may be configured to align with the connection portion 186 of the mounts 150, 152. For example, the connection portion 256 may be implemented as two wings extending from the ring portion 254 in the transverse direction of the cooler body 110. Referring to FIGS. 6-8, the connection portion 256 may include a plurality of fastener holes 288 (e.g., bolt holes) configured to receive the plurality of bolts 500, respectively. Each wing of the connection portion 256 may include a fastener hole 288. The fastener holes 288 (hereinafter "bolt holes" for ease of description) of the connection portion 256 may be configured to align with the bolt holes 188 of the mounts 150, 152. One bolt 500 among the plurality of bolts 500 may penetrate one bolt hole 288 of the coolant collector bracket 200 and a corresponding bolt hole 188 of the mounts 150, 152.

Referring to FIG. 8, the bracket body 202 may further include an extension portion 216 and two end portions 214, 215 each end portion including one mounting interface, e.g., mounting interfaces 250 and 252. The coolant collector bracket 200 may further include a maximum width 290, a first longitudinal axis 218, and a second longitudinal axis 220. A configuration of the bracket body 202 may be configured to reduce space occupied by the coolant collector bracket 200 in the engine system 1000.

The extension portion 216 may be provided between the two end portions 214, 215. The extension portion 216 may extend in the longitudinal direction of the cooler body 110 (FIG. 9). The two end portions 214, 215 may be provided at front and rear ends, respectively, of the extension portion 216.

The end portions 214 may be wider, in a transverse direction of the coolant collector bracket 200, than the extension portion 216. The end portions 214, 215 may have curved edges 224, 225, respectively. The curved edges 224, 225 may have a semicircular curvature.

The curved edges 224, 225 may be provided on a side of the first longitudinal axis 218 (a right side in FIG. 8) which is opposite to the side where the second longitudinal axis 220 is positioned. Widths of the end portions 214, 215 in the transverse direction may gradually decrease in a direction toward the extension portion 216. A side of the end portions 214 (a left side in FIG. 8) opposite the curved edges 224, 225 of the end portions 214, 215 may be straight so as to lie along a same line as a corresponding side (left side) of the extension portion 216. An empty space between curved edge 224 and curved edge 225 may provide room for other components (e.g., the turbocharger system include the turbine 340 and the compressor 350) of the engine system 1000 of FIG. 1.

The maximum width 290 of the coolant collector bracket 200 may extend in the transverse direction. The maximum width 290 may be defined by opposite sides (i.e., left and right sides in FIG. 8) of the mounting interfaces 250 and 252, or alternatively, by left and right sides of the end portions 214, 215. The width 290 of the coolant collector bracket 200 may be less than or equal to the width 140 of the cooler body 110 (FIG. 9).

The first longitudinal axis 218 may connect centers of the two EGR coolant openings 260. The first longitudinal axis 218 may alternatively be referred to as a longitudinal center axis of the mounting interfaces 250. The second longitudinal axis 220 may lie along a center, in the transverse (or left-right) direction, of the extension portion 216. The second longitudinal axis 220 may alternatively be referred to as a longitudinal center axis of the extension portion 216. The second longitudinal axis 220 may be offset, in the transverse direction, with respect to the first longitudinal axis 218. For example, with respect to the coordinate system displayed in FIG. 8, the second longitudinal axis 220 may be provided at a left side of the first longitudinal axis 218.

The mounting interfaces 250, 252 may be formed separately and combined with the end portions 214, 215 of the bracket body 202, or alternatively may be formed integrally with the end portions 214, 215 of bracket body 202. A top surface of the mounting interfaces 250, 252 may be flush with the top surface 204 of the bracket body 202, but aspects of the present disclosure are not limited to an arrangement of the mounting interface 250.

FIG. 9 shows a perspective front view of the cooler 100 mounted to the coolant collector bracket 200. As previously explained, the width 290 of the coolant collector bracket 200 may be less than or equal to the width 140 of the cooler body 110. As an example, the widths 140, 190, and 290 of the cooler body 110, mounts 150, 152 and coolant collector bracket 200 may be equal, but embodiments disclosed herein are not so limited. As another example, the widths 190 and 290 of the mounts 150, 152 and the coolant collector bracket 200 may be less than the width 140 of the cooler body 110. As another example, the width 290 of the coolant collector bracket 200 may be less than the width 190 of the mounts 150, 152 which may be less than the width 140 of the cooler body 110. In yet another example, the width 190 of the mounts 150, 152 may be less than the width 290 of the coolant collector bracket 200, which may be less than the width 140 of the cooler body 110.

An entirety of the mounts 150, 152 may be provided directly under or below the cooler body 110 so as not to extend, in the transverse direction, beyond the cooler body 110. The extension portions of the side surface 170, the connection portion 186 of the bottom surface 180, and the bolts 500 may be provided at positions which do not extend beyond the width 140 of cooler body 110 with respect to the transverse direction and are directly under the cooler body 110.

The cooler 100 may include a plurality of tubes 124 inserted through the cooler body 110 and extending in the longitudinal direction of the cooler body 110. The plurality of tubes 124 may be configured to receive exhaust or other gas. Coolant may flow through the coolant openings 122 (e.g., into a front opening 122 and out a rear opening 122) of the cooler body 110 to surround the plurality of tubes 124 and remove heat from the exhaust.

Referring to FIGS. 1, 3-5, and 7-9, the passages 154 of the mounts 150, 152 may be configured to connect coolant openings 122 of the cooler body 110 to respective EGR coolant openings 260 of the coolant collector bracket 200 so that coolant may be circulated from the cylinder head 320 through the coolant collector bracket 200, mount 150, and cooler body 110. During operation, the coolant openings 122 may act as coolant inlets and outlets, and the EGR coolant openings 260 may act as EGR coolant inlets and outlets.

The coolant openings 122 of cooler body 110 may not be easily aligned with the respective EGR coolant openings 260, and the passages 154 of the mounts 150, 152 along with positions of the top and bottom openings 162 and 182, may be configured based on positions of the coolant openings 122 and the EGR coolant openings 260. For example, the cooler body 110 may have two openings 122 spaced apart in the longitudinal direction of the cooler body 110, and the coolant collector bracket 200 may have two mounting interfaces 250, 252 with two EGR coolant openings 260, respectively, spaced apart in the longitudinal direction of the cooler body 110. A distance between the coolant openings 122 of the cooler 100 may be different (e.g., greater than) a distance between the EGR coolant openings 260 of the coolant collector bracket 200, and the coolant openings 122 may not vertically align with respective EGR coolant openings 260.

The passage 154 of the mounts 150, 152 may be shaped or oriented to connect a coolant opening 122 to a respective EGR coolant opening 260 of the coolant collector bracket 200. When a coolant opening 122 serves as a coolant inlet, the respective EGR coolant opening 260 to which the coolant opening 122 is connected via mount 152 may serve as an EGR coolant outlet, and the coolant inlet 122 may be spaced apart from the EGR coolant outlet 260 in the longitudinal direction of the cooler body 110. Similarly, when a coolant opening 122 serves as a coolant outlet, the respective EGR coolant opening 260 to which the coolant opening 122 is connected via mount 150 may serve as an EGR coolant inlet, and the coolant inlet 122 may be spaced apart from the EGR coolant outlet 260 in the longitudinal direction of the cooler body 110. The previously described offset between the top and bottom openings 162 and 182 of the mounts 150, 152 may account for this spacing between coolant openings 122 and respective EGR coolant openings 260.

INDUSTRIAL APPLICABILITY

The disclosed aspects of the engine system 1000 of the present disclosure may be used to cool and/or recirculate exhaust. The disclosed aspects of the EGR cooler 100, mounts 150, 152 and coolant collector bracket 200 may be used in any appropriate engine system 1000 having a liquid cooling system, and may reduce space occupied in the engine system and also facilitate coolant flow within such engine systems.

Referring to FIGS. 1-9, during operation, the mounts 150, 152 may be configured to allow fluid communication of coolant between the coolant collector bracket 200 and an interior of the cooler body 110 to cool exhaust within the plurality of tubes 124. Coolant may flow from the cylinder head 320 to the coolant collector bracket 200, from the coolant collector bracket 200 through mount 152, and through mount 152 to the EGR cooler 100. Coolant may flow from the EGR cooler 100 through mount 150 back into the coolant collector bracket 200, and to the cylinder block 310.

The mounts 150, 152 may be configured to facilitate this fluid communication even where inlets/outlets (coolant openings 122) of the cooler body 110 may not perfectly align with outlets/inlets (EGR coolant openings 260) of the coolant collector bracket 200. In addition, the mounts 150, 152 may be configured to reduce an overall space occupied by the cooler 100 and coolant collector bracket 200 in the system by maintaining bolts 500 directly under the cooler body 110 and/or by configuring a shape of the coolant collector bracket 200.

Aspects of the present disclosure may provide an EGR mounting system which may facilitate fluid communication between a cylinder head, an EGR cooler, and a bracket vertically supporting the cooler. Aspects of the present disclosure may reduce space occupied by the EGR cooler and EGR mounting system by providing a mount and/or bolting system directly under the EGR cooler. The cooler and coolant collector bracket may be configured to reduce space occupied in an engine system, including an internal combustion engine, to allow convenient positioning of at least one turbine and compressor of a turbocharger system. In addition, at least one mount coupling the cooler to the coolant collector bracket may be configured to reduce space occupied by the cooler and coolant collector bracket in the engine system 1000. Aspects of the present disclosure may provide an EGR mounting system which may facilitate fluid communication even where inlets and outlets of an EGR cooler may not align with corresponding outlets and inlets of a supporting bracket and/or of a cylinder head.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. An exhaust gas recirculation (EGR) cooler for mounting to a coolant collector bracket, comprising:

a cooler body having a top, a bottom, a length extending in a longitudinal direction, and a width extending in a lateral direction perpendicular to the longitudinal direction; and at least one mount coupled to the bottom of the cooler body, wherein:

an interior of the mount is in fluid communication with an interior of the cooler body, a width of the at least one mount in the lateral direction of the cooler body is equal to or less than the width of the cooler body, and the at least one mount is positioned such that the mount does not extend beyond the width of the cooler body.

2. The EGR cooler of claim 1, wherein the at least one mount is welded or brazed to the cooler body.

3. The EGR cooler of claim 1, wherein:

each mount of the at least one mount includes a top opening at least partially aligning with an inlet or an outlet of the cooler body;

each mount of the at least one mount includes a bottom opening; and centers of the top opening and the bottom opening are offset with respect to the longitudinal direction of the cooler body.

4. The EGR cooler of claim 1, wherein:

the cooler body includes a coolant inlet and a coolant outlet;

the at least one mount includes a first mount and a second mount;

the first mount includes a first top opening in fluid communication with the coolant inlet; and the second mount includes a second top opening in fluid communication with the coolant outlet.

5. The EGR cooler of claim 1, wherein each mount of the at least one mount includes:

a mount top surface coupled to the cooler and having a mount top opening;

a mount bottom surface opposite the mount top surface and having a mount bottom opening;

a side surface vertically extending between the mount top and bottom surfaces, and at least one fastener hole configured to receive a fastener.

6. The EGR cooler of claim 5, wherein the at least one fastener hole includes a pair of fastener holes formed in the mount bottom surface, and the mount bottom opening is provided between the pair of fastener holes.

7. The EGR cooler of claim 6, wherein the mount bottom surface includes:

a ring portion defining the mount bottom opening; and a pair of wings extending from the ring portion, each wing having one fastener hole of the pair of fastener holes.

8. The EGR cooler of claim 6, wherein the side surface includes a pair of extension portions extending above the pair of fastener holes, respectively.

9. The EGR cooler of claim 1, wherein the cooler is cylindrical, and the cooler includes a plurality of tubes inserted through the cooler body and extending in the longitudinal direction, the plurality of tubes being configured to receive exhaust.

10. The EGR cooler of claim 1, wherein the at least one mount includes a top surface having a curvature configured to surround a portion of the bottom of the cooler body.

11. An exhaust gas recirculation (EGR) cooler for mounting to a coolant collector bracket, comprising:

a cooler body having a top, a bottom, and a length extending in a longitudinal direction; and at least one mount coupled to a bottom of the cooler body, each mount of the at least one mount including:

a mount top opening at least partially aligning with an inlet or an outlet of the cooler body, and a mount bottom opening, wherein centers of the mount top opening and the mount bottom opening are offset with respect to the longitudinal direction of the cooler body.

12. The EGR cooler of claim 11, wherein the cooler body has a width extending in a lateral direction perpendicular to the longitudinal direction, and a width of the at least one mount extending in the lateral direction of the cooler body is less than or equal to the width of the cooler body.

13. The EGR cooler of claim 11, wherein the at least one mount includes a first mount and a second mount spaced apart in the longitudinal direction of the cooler body.

14. The EGR cooler of claim 13, wherein a distance between the mount bottom openings of the first and second mounts is less than a distance between the mount top openings of the first and second mounts.

15. The EGR cooler of claim 13, wherein:

the first mount and the second mount have a same structure, and the first mount and the second mount are symmetrical with respect to a lateral axis extending in a lateral direction at a position between the first and second mounts.

16. An exhaust gas recirculation (EGR) cooler system, comprising:

an exhaust gas recirculation (EGR) cooler having a length extending in a first direction and a width extending in a second direction;

a coolant collector bracket configured to vertically support the cooler and configured to be coupled to a cylinder head of an internal combustion engine; and at least one mount coupling the cooler to the coolant collector bracket, each mount of the at least one mount having a passage to allow fluid communication between an interior of the cooler and an interior of the coolant collector bracket, wherein widths of the at least one mount and the coolant collector bracket extending in the second direction are less than or equal to the width of the cooler.

17. The EGR system of claim 16, wherein:

the cooler includes a coolant inlet and a coolant outlet;

the coolant collector bracket includes a top surface having an EGR coolant inlet and an EGR coolant outlet; and the passage of the at least one mount is configured to connect the coolant inlet to the EGR coolant outlet or to connect the coolant outlet to the EGR coolant inlet.

18. The EGR system of claim 17, wherein:

the coolant inlet is spaced apart from the EGR coolant outlet with respect to the first direction; and the coolant outlet of the cooler is spaced apart from the EGR coolant inlet with respect to the first direction.

19. The EGR system of claim 16, wherein a longitudinal center axis of an extension portion of the coolant collector bracket extends in the first direction and is offset with respect to a center of the cooler in the second direction.

20. The EGR system of claim 16, wherein:

the mount is brazed or welded to the cooler, the mount is bolted to the coolant collector bracket via at least one bolt, and the at least one bolt is positioned directly under the cooler so as not to extend beyond the width of the cooler.

* * * * *